US006002245A

United States Patent [19]

Sauer

[11] Patent Number: 6,002,245

[45] Date of Patent: Dec. 14, 1999

[54] DUAL REGENERATION BANDGAP REFERENCE VOLTAGE GENERATOR

[75] Inventor: Donald R. Sauer, San Jose, Calif.

[73] Assignee: National Semiconductor Corporation, Santa Clara, Calif.

[21] Appl. No.: 09/258,463

[22] Filed: Feb. 26, 1999

[51] Int. Cl.[6] ..... G05F 3/16

[52] U.S. Cl. ..... 323/315; 323/313; 327/539

[58] Field of Search ..... 323/313, 314, 323/315; 330/257, 288; 327/535, 538, 539

[56] References Cited

U.S. PATENT DOCUMENTS

| | | | |
|---|---|---|---|
| 4,216,394 | 8/1980 | Leidich | 307/296 R |
| 4,472,648 | 9/1984 | Prentice | 307/571 |
| 4,503,381 | 3/1985 | Bowers | 323/315 |
| 4,857,823 | 8/1989 | Bitting | 323/314 |
| 5,087,830 | 2/1992 | Cave et al. | 307/296.6 |
| 5,270,591 | 12/1993 | Ross | 307/530 |
| 5,545,978 | 8/1996 | Pontius | 323/313 |
| 5,739,703 | 4/1998 | Okamura | 326/110 |
| 5,910,748 | 6/1999 | Reffay et al. | 327/432 |

*Primary Examiner*—Matthew Nguyen
*Attorney, Agent, or Firm*—Limbach & Limbach L.L.P.

[57] ABSTRACT

A dual regeneration bandgap voltage generator circuit includes both CMOS and bipolar regeneration bandgap voltage generator circuits. Each of the regeneration bandgap voltage generator circuits is formed by cross-coupling current mirror circuits of opposite conductivity types. Upon initial application of power, the CMOS circuit becomes active first due to its higher leakage current. The "on" current from the CMOS circuit is then used to initiate current conduction within the bipolar circuit. Once the bipolar circuit begins operating, it turns the CMOS circuit off.

20 Claims, 1 Drawing Sheet

DUAL REGENERATION BANDGAP REFERENCE VOLTAGE GENERATOR

BACKGROUND OF THE INVENTION

1. Field of the Invention

The present invention relates to bandgap reference voltage generator circuits, and in particular, to bandgap reference voltage generator circuits using current regeneration techniques.

2. Description of the Related Art

Bandgap reference voltage generator circuits come in a variety of configurations and can be implemented using either, or both, bipolar or metal oxide semiconductor (MOS) transistors. For example, such a circuit can be implemented in a bipolar and complementary MOS (BiCMOS) process and designed to require less than 100 nanoamperes of supply current from the power supply voltage VCC source.

Referring to FIG. 1, one conventional bipolar circuit uses two current mirror circuits Q1/Q2, Q3/Q4 cross-coupled in a telescopic circuit configuration. Hence, the input I1 and output I2 currents of the PNP current mirror circuit Q1/Q2 serve as the output and input currents, respectively, of the NPN current mirror circuit Q3/Q4. Transistor Q2 is typically scaled with a larger emitter area than transistor Q1 (e.g., 3:1), and transistor Q4 is typically scaled to have an emitter area larger than that of transistor Q3 (e.g., 10:1). The resulting bandgap voltage VBG is typically designed to be 1.2 volts.

Frequently, the most important operating characteristic for this type of circuit is its startup characteristic. For example, a fast rise time in the power supply voltage VCC will start it up. However, startup may not occur if the power supply voltage VCC is increased slowly and the temperature is very low (e.g., −55° C.). This is due to the fact that the low current beta characteristic of the transistors Q1, Q2, Q3, Q4 is often too low to support sufficient leakage current to provide the current regeneration process necessary at very low temperatures, particularly over variations in the manufacturing processes. Further, even if the circuit initially starts up properly, in the event that the power supply voltage VCC drops low enough to shut down the circuit, the circuit may not turn back on once the supply voltage VCC has been returned to its correct value.

Referring to FIG. 2, a different situation is encountered when CMOS devices replace the bipolar devices. (This circuit is similar to that of FIG. 1 in that it is formed of a PMOS current mirror circuit M1/M2 cross-coupled with an NMOS current mirror circuit M3/M4 in a telescopic circuit configuration.) Transistors M2 and M4 are typically scaled to have wider channel dimensions than transistors M1 and M3, respectively (e.g., 3:1). Even at very low temperatures, the leakage current through a MOS transistor is not zero, notwithstanding the sophisticated processes presently used in fabricating the devices. Either the NMOS or PMOS devices are going to leak more than the other devices.

For example, in the event that the NMOS transistor leak more, the leakage current in transistor M4 will cause the PMOS transistors M1, M2 to turn on (due to the biasing of the gate-source region of transistor M1 caused by the leakage current through transistor M4). As the voltage drop across the gate-source region of transistor M1 increases, current I1 increases. As current I1 increases, current I2, which is a scaled-up replica of current I1, causes the voltage potential at the gate terminals of transistors M3 and M4 to increase. This process continues until a sufficiently large current I1 flows through a resistor R2 to cause the loop gain to become unity. (It will be understood that if, instead, the PMOS transistors Ml, M2 had higher leakage currents than the NMOS transistors M3, M4, this same current regeneration process would take place.)

SUMMARY OF THE INVENTION

A dual regeneration bandgap reference voltage generator circuit in accordance with the present invention uses bipolar and CMOS technologies to implement both bipolar and CMOS current regeneration techniques. During initial startup, the CMOS circuit performs current regeneration to initiate operation of the bipolar circuit. Once this CMOS current regeneration has initiated bipolar circuit operation, bipolar current regeneration begins and the bipolar circuit causes the CMOS circuit to turn off.

In accordance with one embodiment of the present invention, a BiCMOS bandgap reference voltage generator circuit includes power terminals, a CMOS bandgap voltage generator circuit and a bipolar bandgap voltage generator circuit. The CMOS bandgap voltage generator circuit is coupled to and configured to conduct a CMOS current from at least one of the power terminals. The bipolar bandgap voltage generator circuit is coupled to the power terminals and the CMOS bandgap voltage generator circuit and is configured to conduct the CMOS current and in response thereto conduct a bipolar current between the power terminals and in accordance therewith provide a BiCMOS bandgap reference voltage. In response to an application of power across the power terminals, the CMOS bandgap voltage generator circuit conducts a CMOS leakage current and in response thereto transitions from a CMOS off state to a CMOS on state and conducts the CMOS current. In response to the conduction of the CMOS current, the bipolar bandgap voltage generator circuit transitions from a bipolar off state to a bipolar on state and in accordance therewith conducts the bipolar current and causes the CMOS bandgap voltage generator circuit to transition from the CMOS on state to the CMOS off state.

In accordance with another embodiment of the present invention, a BiCMOS bandgap reference voltage generator circuit includes power terminals, first and second MOS current mirror circuits, first and second bipolar current mirror circuits, and first and second resistive circuits. The first MOS current mirror circuit is of a first MOS conductivity type and is coupled to one of the power terminals. The second MOS current mirror circuit is of a second MOS conductivity type opposite to the first MOS conductivity type and is coupled to the first MOS current mirror circuit. The first bipolar current mirror circuit is of a first bipolar conductivity type and is coupled to the one power terminal and the second MOS current mirror circuit. The first resistive circuit is coupled to the first bipolar current mirror circuit and the second MOS current mirror circuit. The second bipolar current mirror circuit is of a second bipolar conductivity type opposite to the first bipolar conductivity type and is coupled to the first bipolar current mirror circuit, the first resistive circuit and another one of the power terminals. The second resistive circuit is coupled to the second bipolar current mirror circuit and another one of the power terminals.

In accordance with still another embodiment of the present invention, a method of generating a BiCMOS bandgap reference voltage includes the steps of:

conducting a CMOS leakage current in response to an application of power across a plurality of power terminals;

transitioning from a CMOS off state to a CMOS on state in response to the conduction of the CMOS leakage current and in accordance therewith conducting a CMOS on current;

transitioning from a bipolar off state to a bipolar on state in response to the conduction of the CMOS on current and in accordance therewith conducting a bipolar on current;

transitioning from the CMOS on state to the CMOS off state in response to the conduction of the bipolar on current and in accordance therewith conducting another CMOS leakage current; and generating a bandgap reference voltage in accordance with the conduction of the bipolar on current.

In accordance with yet another embodiment of the present invention, a method of generating a BiCMOS bandgap reference voltage includes the steps of:

conducting and mirroring a MOS leakage current;

conducting and mirroring a MOS on current in response to the MOS leakage current;

conducting and mirroring a bipolar on current in response to the MOS on current;

terminating the conducting and mirroring of the MOS on current and conducting and mirroring another MOS leakage current in response to the bipolar on current; and generating a bandgap reference voltage in accordance with the conducting and mirroring of the bipolar on current.

These and other features and advantages of the present invention will be understood upon consideration of the following detailed description of the invention and the accompanying drawings.

DETAILED DESCRIPTION OF THE INVENTION

Figure 1:
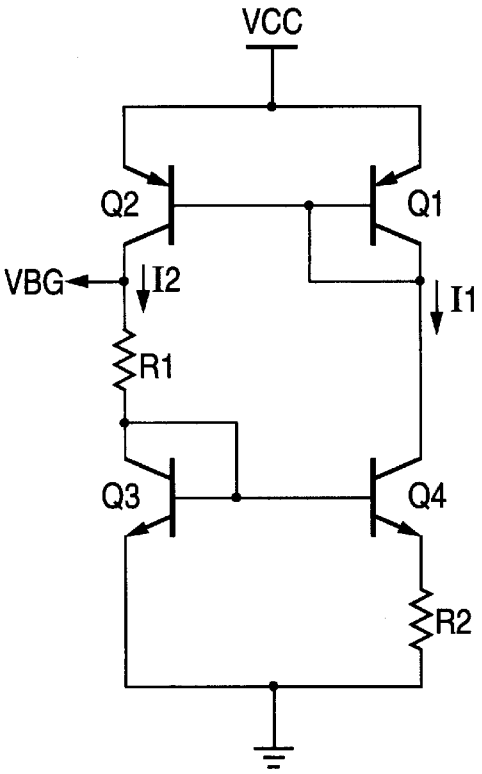
FIGURE 1 (PRIOR ART)
FIG. 1 is a circuit schematic of a conventional bipolar bandgap reference voltage generator circuit.
Figure 2:
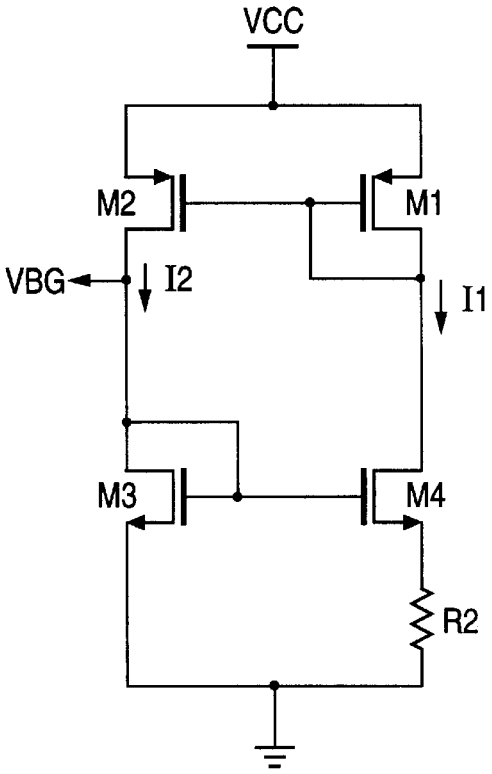
FIGURE 2 (PRIOR ART)
FIG. 2 is a circuit schematic of a conventional CMOS bandgap reference voltage generator circuit.
Figure 3:
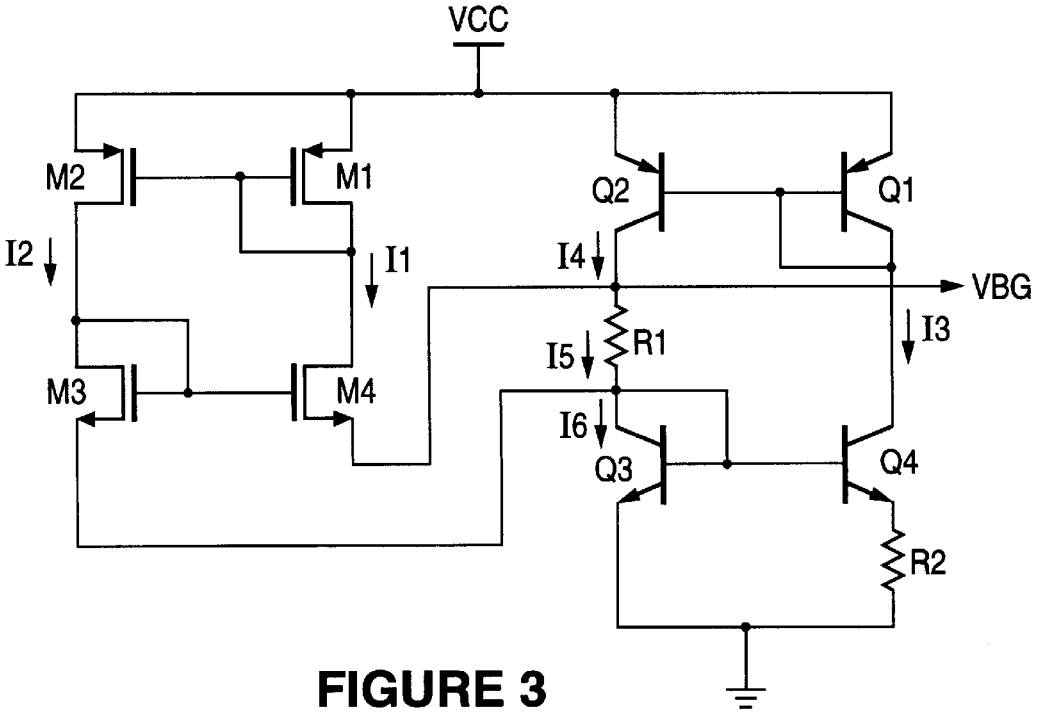
FIG. 3 is a circuit schematic of a dual regeneration bandgap reference voltage generator circuit in accordance with one embodiment of the present invention.

Referring to FIG. 3, a bandgap reference voltage generator circuit in accordance with one embodiment of the present invention uses cross-coupled PMOS M1/M2 and NMOS M3/M4 current mirror circuits coupled with cross-coupled PNP Q1/Q2 and NPN Q3/Q4 current mirror circuits and resistors R1 R2, substantially as shown. Current mirror output transistors M2 and M4 are scaled to have wider channels than current mirror input transistors M1 and M3, respectively (e.g., 3:1). Similarly, current mirror output transistors Q2 and Q4 are scaled to have larger emitter areas than current mirror input transistors Ql and Q3 (e.g., 3:1 and 10:1), respectively. Depending upon the process used, values for resistors R1 and R2 can be 8 megohms and 4 megohms, respectively.

During startup, the CMOS circuit performs current regeneration. Hence, the initial leakage current values for currents I1 and I2 begin increasing until all transistors M1, M2, M3, M4 are turned on, thereby establishing the CMOS "on" current values for currents I1 and I2. Until the bipolar transistors begin to turn on, current I1 forms the current I5 through resistor Ri. This current I5 (I1) sums with current I2 to form current 16 through transistor Q3. This current I6 serves as the input current to the NPN current mirror circuit Q3/Q4 and causes current regeneration to begin within the bipolar current mirror circuits Q3/Q4, Q1/Q2. As the bipolar current regeneration increases, currents I3 and 14 increase. Current 14 sums with current I1 in resistor II, thereby causing current I5 to increase. Once current I5 is sufficiently high to cause approximately 600 millivolts of voltage drop across resistor RI, transistor M4 is turned off, thereby terminating the flow of "on" current within the CMOS circuit. Accordingly, the MOS transistors M1, M2, M3, M4 return to an off state, thereafter drawing only leakage current from the power supply source VCC.

Based upon the foregoing, it should be understood that the CMOS circuit serves to provide a form of "kick-start" current to initiate current regeneration within the bipolar circuit. For example, in a typical circuit fabrication process, NPN transistors have a beta of approximately two at one picoampere of current at −55° C., while PNP transistors have a beta even greater. Accordingly, when the voltage across resistor RI increases beyond eight microvolts (for R1=8 megohms), the bipolar circuit has sufficient bias current, even at −55° C., to initiate bipolar current regeneration.

With respect to the CMOS circuit, at leakage current levels, the loop gain can be as high as nine. While this may be somewhat problematic, depending upon the size of any offsets among the MOS transistors, these devices can be scaled as necessary for providing better matching. Any impacts on circuit area due to such matching will be minimal since these devices are significantly smaller than the resistors anyway.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a BiCMOS bandgap reference voltage generator circuit, comprising:

a plurality of power terminals;

a CMOS bandgap voltage generator circuit coupled to and configured to conduct a CMOS current from at least one of said plurality of power terminals;

and a bipolar bandgap voltage generator circuit, coupled to said plurality of power terminals and said CMOS bandgap voltage generator circuit, configured to conduct said CMOS current and in response thereto conduct a bipolar current between said power terminals and in accordance therewith provide a BiCMOS bandgap reference voltage;

wherein in response to an application of power across said plurality of power terminals, said CMOS bandgap voltage generator circuit conducts a CMOS leakage current and in response thereto transitions from a CMOS off state to a CMOS on state and conducts said CMOS current, and in response to said conduction of said CMOS current, said bipolar bandgap voltage generator circuit transitions from a bipolar off state to a bipolar on state and in accordance therewith conducts said bipolar current and causes said CMOS bandgap voltage generator circuit to transition from said CMOS on state to said CMOS off state.

2. The apparatus of claim 1, wherein said CMOS bandgap voltage generator circuit comprises first and second MOS current mirror circuits which are of opposite MOS conductivity types and are coupled in a telescopic circuit configuration.

3. The apparatus of claim 2, wherein:

said first MOS current mirror circuit conducts a first MOS current as a first input current and a second MOS current as a first output current;

said second MOS current is a multiple of said first MOS current; and said second MOS current mirror circuit conducts said second MOS current as a second input current and said first MOS current as a second output current.

4. The apparatus of claim 1, wherein said bipolar bandgap voltage generator circuit comprises first and second bipolar current mirror circuits which are of opposite bipolar conductivity types and are coupled in a telescopic circuit configuration.

5. The apparatus of claim 4, wherein:

said first bipolar current mirror circuit conducts a first bipolar current as a first input current and a second bipolar current as a first output current;

said second bipolar current is a multiple of said first bipolar current; and said second bipolar current mirror circuit conducts said second bipolar current as a second input current and said first bipolar current as a second output current.

6. The apparatus of claim 5, wherein one of said first and second bipolar current mirror circuits firther conducts said CMOS current as an additional respective one of said first and second input currents.

7. The apparatus of claim 1, wherein said bipolar bandgap voltage generator circuit includes a resistive circuit which conducts a portion of said CMOS current and to which said CMOS bandgap voltage generator circuit is coupled.

8. An apparatus including a BiCMOS bandgap reference voltage generator circuit, comprising:

a plurality of power terminals;

a first MOS current mirror circuit, of a first MOS conductivity type, coupled to one of said plurality of power terminals;

a second MOS current mirror circuit, of a second MOS conductivity type opposite to said first MOS conductivity type, coupled to said first MOS current mirror circuit;

a first bipolar current mirror circuit, of a first bipolar conductivity type, coupled to said one of said plurality of power terminals and said second MOS current mirror circuit;

a first resistive circuit coupled to said first bipolar current mirror circuit and said second MOS current mirror circuit;

a second bipolar current mirror circuit, of a second bipolar conductivity type opposite to said first bipolar conductivity type, coupled to said first bipolar current mirror circuit, said first resistive circuit and another one of said plurality of power terminals; and a second resistive circuit coupled to said second bipolar current mirror circuit and said another one of said plurality of power terminals.

9. The apparatus of claim 8, wherein:

in response to an application of power across said plurality of power terminals, said first and second MOS current mirror circuits conduct a MOS leakage current and in response thereto transition from a MOS off state to a MOS on state and conduct a MOS current; and in response to said conduction of said MOS current, said first and second bipolar current mirror circuits transition from a bipolar off state to a bipolar on state and in accordance therewith conduct a bipolar current and cause said first and second MOS current mirror circuits to transition from said MOS on state to said MOS off state.

10. The apparatus of claim 8, wherein said first and second MOS current mirror circuits are coupled in a telescopic circuit configuration.

11. The apparatus of claim 10, wherein:

said first MOS current mirror circuit conducts a first MOS current as a first input current and a second MOS current as a first output current;

said second MOS current is a multiple of said first MOS current; and said second MOS current mirror circuit conducts said second MOS current as a second input current and said first MOS current as a second output current.

12. The apparatus of claim 8, wherein said first and second bipolar current mirror circuits are coupled in a telescopic circuit configuration.

13. The apparatus of claim 12, wherein:

said first bipolar current mirror circuit conducts a first bipolar current as a first input current and a second bipolar current as a first output current;

said second bipolar current is a multiple of said first bipolar current; and said second bipolar current mirror circuit conducts said second bipolar current as a second input current and said first bipolar current as a second output current.

14. The apparatus of claim 13, wherein one of said first and second bipolar current mirror circuits further receives and conducts a MOS current from said second MOS current mirror circuit as an additional respective one of said first and second input currents.

15. A method of generating a BiCMOS bandgap reference voltage, comprising the steps of:

conducting a CMOS leakage current in response to an application of power across a plurality of power terminals;

transitioning from a CMOS off state to a CMOS on state in response to said conduction of said CMOS leakage current and in accordance therewith conducting a CMOS on current;

transitioning from a bipolar off state to a bipolar on state in response to said conduction of said CMOS on current and in accordance therewith conducting a bipolar on current;

transitioning from said CMOS on state to said CMOS off state in response to said conduction of said bipolar on current and in accordance therewith conducting another CMOS leakage current; and generating a bandgap reference voltage in accordance with said conduction of said bipolar on current.

16. The method of claim 15, wherein said step of transitioning from a CMOS off state to a CMOS on state in response to said conduction of said CMOS leakage current and in accordance therewith conducting a CMOS on current comprises activating a CMOS regeneration bandgap voltage generator circuit.

17. The method of claim 15, wherein said step of transitioning from a bipolar off state to a bipolar on state in response to said conduction of said CMOS on current and in accordance therewith conducting a bipolar on current comprises activating a PNP and NPN bipolar regeneration bandgap voltage generator circuit.

18. A method of generating a BiCMOS bandgap reference voltage, comprising the steps of:

conducting and mirroring a MOS leakage current;

conducting and mirroring a MOS on current in response to said MOS leakage current;

conducting and mirroring a bipolar on current in response to said MOS on current;

terminating said conducting and mirroring of said MOS on current and conducting and mirroring another MOS leakage current in response to said bipolar on current; and generating a bandgap reference voltage in accordance with said conducting and mirroring of said bipolar on current.

19. The method of claim 18, wherein said step of conducting and mirroring a MOS on current in response to said MOS leakage current comprises activating a CMOS regeneration bandgap voltage generator circuit.

20. The method of claim 18, wherein said step of conducting and mirroring a bipolar on current in response to said MOS on current comprises activating a PNP and NPN bipolar regeneration bandgap voltage generator circuit.

* * * * *

UNITED STATES PATENT AND TRADEMARK OFFICE

CERTIFICATE OF CORRECTION

PATENT NO.: 6,002,245
DATED: December 14, 1999
INVENTOR(S): Donald R. Sauer

It is certified that an error appears in the above-identified patent and that said Letters Patent is hereby corrected as shown below:

In Col. 5, line 38, delete "firther" and replace with --further--.

Signed and Sealed this

Fourth Day of July, 2000

*Attest:*

Q. TODD DICKINSON

*Attesting Officer*

*Director of Patents and Trademarks*